United States Patent [19]

Akira et al.

[11] 4,030,921

[45] June 21, 1977

[54] ELECTROPHOTOGRAPHIC PHOTOSENSITIVE MATERIAL

[75] Inventors: Kato Akira; Itoh Akira; Uchida Tohru, all of Hachioji; Ishihara Masao, Hino, all of Japan

[73] Assignee: Konishiroku Photo Industry Co., Ltd., Hachioji, Japan

[22] Filed: Nov. 10, 1975

[21] Appl. No.: 630,413

[30] Foreign Application Priority Data

Nov. 19, 1974 Japan ..... 49-133262

[52] U.S. Cl. ..... 96/1.5; 96/1.8; 96/86 R

[51] Int. Cl.[2] ..... G03G 5/04

[58] Field of Search ..... 96/1.5, 1.8, 1.6, 1.7

[56] References Cited

UNITED STATES PATENTS

| | | | |
|---|---|---|---|
| 3,437,481 | 4/1969 | Graver et al. | 96/1.8 |
| 3,901,700 | 8/1975 | Yoerger | 96/1.5 |
| 3,910,187 | 10/1975 | Cords | 96/35.1 |
| 3,947,271 | 3/1976 | Munzel et al. | 96/1 R |

*Primary Examiner*—John D. Welsh

*Attorney, Agent, or Firm*—Lane, Aitken, Dunner & Ziems

[57] ABSTRACT

There is described an electrophotographic photosensitive material including a conductive backing and a photosensitive layer, the photosensitive layer being formed of a photoconductive material, a resin binder, and a fluorine-contained resin. The fluorine-contained resin is a polymer or copolymer having a fluorine-contained monomer as its structural units and is preferably soluble in solvent.

4 Claims, No Drawings

ELECTROPHOTOGRAPHIC PHOTOSENSITIVE MATERIAL

BACKGROUND OF THE INVENTION

This invention relates to an electrophotographic photosensitive material which may repeatedly be used.

In electrophotography, there are well known a method wherein an electrostatic latent image is formed on a photosensitive layer and is then developed by a developer to form a toner image and the thus formed toner image is fixed on the photosensitive layer, and a method wherein, after the formation of a toner image on a photosensitive layer, the toner image is transferred to a transferring material and is then fixed on a final support. The latter method in which toner image is transferred has two kinds of photosensitive materials being generally and widely employed, one using a vacuum evaporation film of selenium as a photosensitive layer and the other using a photosensitive layer wherein photoconductive powder such as zinc oxide or cadmium sulfide is dispersed in a binder of a polymeric material with high insulating property. (The latter will be hereinlater referred to as a bindery-type electrophotographic photosensitive material) In recent years, the binder-type photosensitive material has been widely used in electrophotography of the type in which toner image is repeatedly transferred at every cycle of reproducing operations instead of selenium photosensitive material.

In general, binder resins which are employed in the photosensitive layer of the binder-type photosensitive element are thermoplastic resins which are relatively low in mechanical strengths, so that the surface of the photosensitive layer is impaired and damaged to a considerable extent when repeatedly rubbed with a developing brush, a cleaner brush and a transfer sheet and is therefore soiled with a toner, quality of reproduced images being thus lowered.

In order to overcome this, thermosetting resins with relatively high mechanical strength are employed as a binder resin instead of thermoplastic resins. For example, Japanese Patent Publication No. 2966/1973 describes a method for forming a binder-type photosensitive layer by using photoconductive zinc oxide or titanium dioxide and a thermosetting isocyanate-alkyd resin. However, such thermosetting resins have such a shortcoming that when they are used for forming a binder-type photosensitive layer alone, the surface of the photosensitive layer is apt to be cracked while it is excellent in hardness. As a result, similarly to a photosensitive layer using thermoplastic resins, the surface of the photosensitive layer is readily turned rough during duplication operations, so that a toner is readily sticked to and soils the surface of the photosensitive layer, thus lowering photosensitivity, quality of reproduced image and durability of the photosensitive layer. Further, when binder resins are repeatedly subjected to corona discharge and exposed to light, they are partially decomposed by the action of, for example, ozone to form therein hydrophilic groups such as a hydroxyl group, a carboxyl group, etc. As a consequence, the photosensitive layer is lowered in electric resistance and is hard to be charged, showing a phenomenon of fatigue.

Further, there has been proposed a method for forming a teflon or polyfluoroethylene resin layer on the outer surface of a binder-type photosensitive layer for the purpose of covering and protecting the surface of the photosensitive layer. This method is useful in improving resistance to mechanical abrasion against the surface of the photosensitive layer. However, the method is disadvantageous in that, upon formation of an electrostatic latent image by charging and exposing to light the surface of the photosensitive layer, the residual electric charge in areas where exposed is increased, with the result that development of such electrostatic latent image with a developer produces a considerable fog.

BRIEF SUMMARY OF THE INVENTION

It is therefore an object of the present invention to provide a binder-type electrophotographic photosensitive material which is excellent in abrasion and corona resistances.

It is another object of the present invention to provide a binder-type electrophotographic photosensitive material which has a photosensitive layer with smooth surface and which is free from the deterioration in photosensitivity, image quality and durability of the material as experienced in the conventional photosensitive material due to the photosensitive layer soiled by developing powders.

It is further object of the present invention to provide a binder-type electrophotographic photosensitive material which is free from the generation of fog.

It is a still further object of the invention to provide a xerographic photosensitive material which is suitable for producing stable duplication images even when repeatedly used over a long period of time.

DETAILED DESCRIPTION OF THE INVENTION

The above and other objects of the present invention are attained by an electrophotographic photosensitive material which comprises a photosensitive layer formed on a conductive backing, said photosensitive layer including a photoconductive material, a binder, and a fluorine-contained resin, i.e., a polymer or copolymer having therein a fluorine monomer units. By having a fluorine-contained resin along with a binder resin contained in a photosensitive layer of a binder-type electrophotographic photosensitive material, the surface of the photosensitive layer becomes not only smooth but also small in abrasiveness, showing no deterioration in photosensitivity, quality of reproduced image and durability of the layer as would be otherwise caused by the attachment of developing powder to the layer surface. In addition, such photosensitive layer has high corona resistance and therefore undergoes no deterioration in electrophotographic properties thereof even when repeatedly used in the repeated transfer-type electrophotographic system over a long period of time.

The photoconductive materials useful in the present invention are those which are generally employed for this purpose and include, for example, inorganic photoconductive materials such as zinc oxide, zinc sulfide, cadmium sulfide, cadmium selenide and titanium dioxide, and organic photoconductive materials such as polyvinylcarbazole, etc.

The fluorine-contained resins are, as mentioned hereinbefore, polymers or copolymers which contain therein fluorine monomer units, and are preferred to be soluble in solvent. The fluorine-contained resins suitable for the purpose of the present invention are those which have recurring units of the following formula (I) or (II)

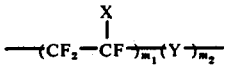

(I)

(wherein X represents a fluorine atom, a chlorine atom or a trifluoromethyl group, Y represents a monomer copolymerizable with the fluorine monomer, and $m_1$ and $m_2$ independently represents a polymerization mole percent and $m_1 = 95 - 10$ and correspondingly $m_2 = 5 - 90$), or

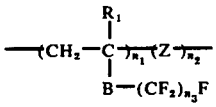

(II)

(wherein $R_1$ represents a hydrogen atom or a methyl group, Z represents a monomer copolymerizable with a fluorine monomer, B represents $-COA(CH_2)_n-$,

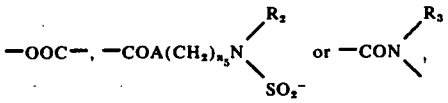

(in which $R_2$ and $R_3$ are independently an alkyl group containing from 1 to 4 carbon atoms, A represents —O— or —NH—, $n_4$ and $n_5$ are independently an integer of from 1 to 4), $n_1$ and $n_2$ independently represent a polymerization mol percent and $n = 100 - 10$ and correspondingly $n_2 = 0 - 90$, and $n_3$ are an integer of from 1 to 18). As for example of the copolymerizable monomers Y of formula (I) and Z of formula (II) there are used an acrylic acid alkyl ester, a methacrylic acid alkyl ester, vinylpyrrolidone, vinyl chloride, vinyl acetate, vinylbutyral, styrene, acrylamide, vinylidene fluoride, acrylonitrile, and butadiene. These monomers may be used singly or in combination.

The fluorine-contained resins expressed by the recurring units of the above-mentioned formulae (I) and (II) are, for example, those which have the following recurring units

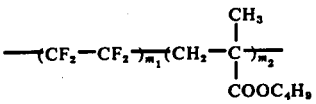

(1)

(wherein $m_1$:$m_2$ = 80:20 and an average molecular weight $\overline{M}$ = 75,000)

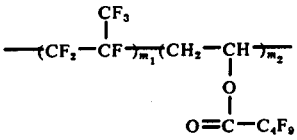

(2)

(wherein $m_1$:$m_2$ = 30:70 and an average molecular weight $\overline{M}$ = 65,000)

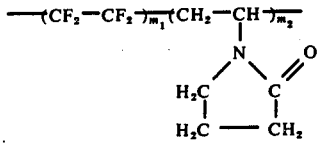

(3)

(wherein $m_1$:$m_2$ = 15:85 and $\overline{M}$ = 100,000)

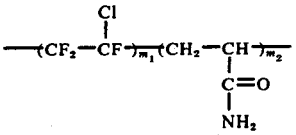

(4)

(wherein $m_1$:$m_2$ = 65:35 and $\overline{M}$ = 67,000)

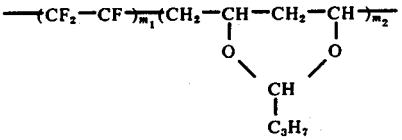

(5)

(wherein $m_1$:$m_2$ = 50:50 and $\overline{M}$ = 85,000)

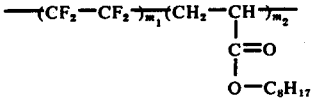

(6)

(wherein $m_1$:$m_2$ = 60:40 and $\overline{M}$ = 57,000)

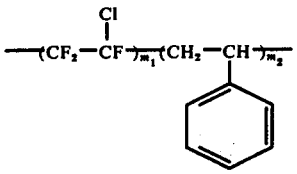

(7)

(wherein $m_1$:$m_2$ = 30:70 and $\overline{M}$ = 75,000)

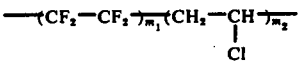

(8)

(wherein $m_1$:$m_2$ = 15:85 and $\overline{M}$ = 70,000)

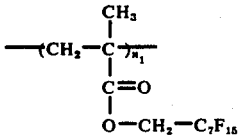

(9)

(wherein $n_1$ = 100 and $\overline{M}$ = 75,000)

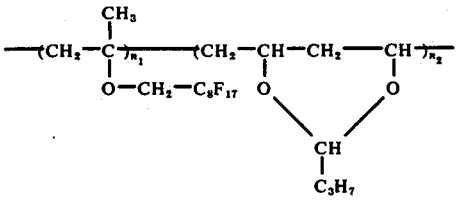

(10)

(wherein $n_1$:$n_2$ = 50:50 and $\overline{M}$ = 120,000)

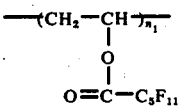

(11)

(wherein $n_1$ = 100 and $\overline{M}$ = 78,000)

(12)

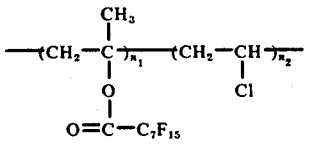

(wherein $n_1:n_2 = 45:55$ and $\overline{M} = 95{,}000$)

(13)

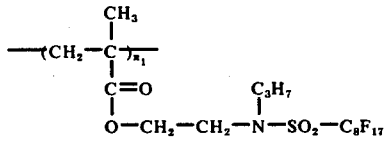

(wherein $n_1 = 100$ and $\overline{M} = 95{,}000$)

(14)

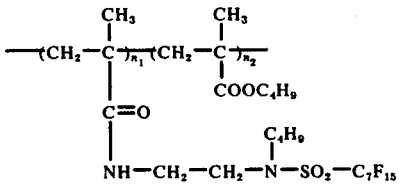

(wherein $n_1:n_2 = 30:70$ and $\overline{M} = 100{,}000$)

(15)

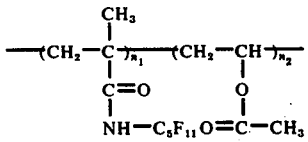

(wherein $n_1:n_2 = 30:70$ and $\overline{M} = 75{,}000$)

(16)

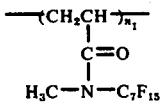

(wherein $n_1 = 100$ and $\overline{M} = 85{,}000$) and (17)

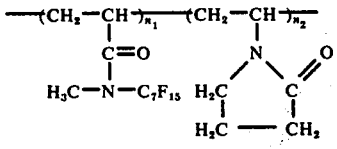

(wherein $n_1:n_2 = 50:50$ and $\overline{M} = 95{,}000$)

These fluorine-contained resins can be readily prepared by an ordinary solution polymerization method. Further, commercially available fluorine-contained resin products such as AG-650 (trade name, produced by Ashai Glass K.K.) and FC-706 (produced by Minnesota Mining and Manufacturing Company) may be also employed in the present invention.

The binder-type electrophotographic photosensitive material of the present invention can be manufactured by forming the aforesaid photosensitive layer onto a conductive backing such as a metal plate, or a sheet or film of an electrical insulating material such as paper or plastics one surface of which is vacuum-evaporated or laminated with aluminum in the form of a thin layer or which is coated with a carbon-resin dispersion and dried. If necessary, an intermediate layer or an undercoating layer may be provided between the photosensitive layer and the conductive backing with use of casein, gelatin, ethyl cellulose, starch, polyvinylbutyral or polyvinyl acetate.

The formation of the photosensitive layer will now be particularly described. For example, a photosensitive solution or dispersion of the following formulation is first prepared.

| | |
|---|---|
| photoconductive zinc oxide | 100 g |
| 2 % alcohol solution of Rose Bengale, Bromophenol Blue, Bromothymol Blue or Auramine as sensitizing dye | 0.1 – 30 ml |
| 10 % silicon oil in toluene as coating modifier | 0.1 – 10 ml |
| thermoplastic or thermosetting binder resin which is conventionally employed in electrophotography and which includes a polymer or copolymer of butadiene, styrene, an acrylic acid ester, a methacrylic acid ester, vinyl chloride, vinyl acetate, vinylidene chloride, acrylic acid or methacrylic acid, nitrocellulose, cellulose acetate, ethyl cellulose, melamin resin, epoxy resin, alkyd resin, silicon resin or rubber chloride | 10 – 50 g |
| fluorine-contained resin | 0.01 – 10 g |
| solvent such as toluene, benzene, xylene, ethyl acetate, acetone, methyl ethyl ketone, trichloroethylene, trifluorotrichloroethylene, or tetrahydrofuran | 50 – 500 ml |

In the preparation, the solid materials are dispersed in the liquids in a dispersing means such as a ball mill for about 4 hours. Then, the resultant photosensitive solution or dispersion is applied onto the conductive backing by an ordinary coating method such as a dipping, double roll, Gieβer, air doctor, or spraying method in such a manner that the photosensitive layer has a dry thickness of 5 – 50 μ. The applied solution is dried in a hot air of 60° – 80° C and is then subjected to thermal treatment in a dryer of 80° – 150° C for several hours, if required.

As will be understood from the foregoing formulae (I) and (II), the fluorine-contained resins useful in the present invention are those which have structural units similar to those of a teflon or a polytetrafluoroethylene or which are vinyl derivatives having a fluorine-substituted alkylene group at the side chain thereof, both of which are soluble in solvent, and which are homopolymers of fluorine compounds or monomers or copolymers of fluorine compounds with other copolymerizable monomers. With the copolymers, it is desirable that the fluorine monomers be contained in an amount of greater than 5 mol %.

The polymers or copolymers have generally an average molecular weight of 10,000 – 500,000, preferably 20,000 – 200,000. The amount of the fluorine-contained resins varies depending upon the kinds of binder and photoconductive material and the amount of binder, however, it is generally in the range of 0.01 – 10% by weight of the photoconductive material. The commercially available fluorine-contained resin products, AG-650, FC-706, etc., may be similarly used in the present invention by dissolving the same in organic solvent. While, the amount of the binder resin is in the range of 10 –50% by weight of the photoconductive material.

It should be noted that the fluorine-contained resins may be used in combination with either an inorganic photoconductive material or an organic photoconductive material, showing similar excellent electrophotographic results in either case. With a photosensitive material comprising in combination a selenium-deposited photosensitive layer and a photosensitive layer using an organic photoconductive material, solvent-soluble fluorine-contained resins may be applied to the photosensitive layer using organic photoconductive material.

The electrophotographic photosensitive material of the invention is improved not only in charging characteristics and a image-bearing property of the photosensitive layer, but also in mechanical abrasiveness and electrical impactness. In addition, the photosensitive layer is imparted thereto a slipping property (i.e., a hard-to-stick property by which developing powder is hard to stick to the surface of the photosensitive layer), so that the photosensitive material is improved to a considerable extent and the surface thereof is easy to be cleaned by a suitable means, it being possible to repeatedly yield stable reproduction images over a period of time.

The present invention will be particularly illustrated by way of the following examples, which are presented for purposes of illustration only and should not be construed as limiting thereto the present invention.

EXAMPLE 1

On a conductive support which was composed of a polyester film laminated with an aluminum thin film thereon was formed a casein intermediate layer in a thickness of 2 $\mu$. Then, a photosensitive composition of the following formulation was applied onto the casein intermediate layer by means of a wire bar in such a manner as to have a dry film thickness of 15 $\mu$ (i.e., 25 g/m$^2$) and dried in a hot air of 70° C. After completion of the drying, the photosensitive layer was further thermally treated in a dryer of about 90° C for 3 hours to obtain a photosensitive material or element (sample No. 1).

| | |
|---|---|
| photoconductive zinc oxide powder | 100 g |
| thermosetting acrylic resin (50 % solution in toluene) | 30 ml |
| melamine resin (50 % solution in toluene) | 6 ml |
| 2 % Rose Bengale solution in methyl alcohol | 15 ml |
| toluene | 150 ml |
| 10 % solution of fluorine-contained resin of the foregoing exemplification (1) in trifluorotrichloroethylene | 12 ml |

The above procedure was repeated using instead of the exemplified resin (I) the exemplified fluorine-contained resins (3), (9), (11), (13), (15) and (17) and 1.2 g of each of commercially available solvent-soluble fluorine-contained resins, AG-650 and FC-706, thereby to make photosensitive elements (sample Nos. 2 – 9), respectively. Besides, a comparative sample (sample No. 10) was made in the same manner as described above without use of any fluorine-contained resin.

These samples and comparative sample were independently mounted in a commercially available repeated transfer-type electro duplicator Model U-BIX-800 (produced by Konishiroku Photo Co., Ltd.) to continuously take 1000 copies for each sample. The reduction in image densities at a normal and a high humidities and the degree of coarseness or indistinctness of images of the resultant copies were determined for comparative purpose. The test results are shown in Table I below.

Table 1

| Sample No. | fluorine-contained resin | reduction image density at a normal humidity | reduction in image density at high humidity | degree of coarseness of reproduction image |
|---|---|---|---|---|
| 1 | exemplified resin No. 1 | 95 | 85 | very slight |
| 2 | " No. 3 | 91 | 80 | slight |
| 3 | " No. 9 | 96 | 84 | very slight |
| 4 | " No. 11 | 95 | 85 | " |
| 5 | " No. 13 | 95 | 86 | " |
| 6 | " No. 15 | 92 | 81 | slight |
| 7 | " No. 17 | 94 | 84 | very slight |
| 8 | AG-650 | 94 | 84 | " |
| 9 | FC-706 | 95 | 85 | " |
| Comparative Sample 10 | | 60 | 40 | great |

The reduction in image density at a normal humidity was determined as follows: the image density of the first copy (at a spot with a density of 1.0) obtained at 20° C in a relative himidity of 60% was considered to be 100 and the image density corresponding to the spot of the last (or 1000th) copy was expressed in a value relative to that of the first copy. Similarly, the reduction in image density at high humidity was determined by considering as 100 an image density (at a spot with a density of 1.0) of the first copy obtained at 25° C in a relative humidity of 80% and expressing an image density corresponding to the spot of the last copy in a value relative to that of the first copy. The degree of coarseness of image was expressed by three ranks, i.e., "great", "slight" and "very slight".

As will be understood from the Table, the samples of the present invention are smaller in reductions of image density due to filming of developing powder (i.e., a phenomenon of permitting developing powder to attach to photosensitive layer) and due to deterioration in electric properties than the comparative sample. Additionally, the degree of coarseness of image will be found to be very slight.

EXAMPLE 2

Example 1 was repeated using a photosensitive solution, with or without use of a fluorine-contained resin, of the following formulation to make a sample of the invention and a comparative sample, respectively.

| | |
|---|---|
| photoconductive cadmium sulfide powder | 100 g |
| thermosetting alkyd resin (50 % solution) in toluene) | 36 ml |
| 10 % solution of exemplified fluorine- | |

-continued

| | |
|---|---|
| contained resin (3) in trifluoro-trichloroethylene | 12 ml |
| toluene | 150 ml |

The sample and the comparative sample were, respectively, placed in position in the duplicator Model U-BIX-800. Then, Example 1 was repeated to take 1000 copies in each case for determination of reductions of image density at a normal humidity and at high humidity. As a result, the sample using the fluorine-contained resin was found to be much more excellent in comparison with the comparative sample.

EXAMPLE 3

On a conductive support which was obtained by laminating an aluminum film on a polyester film was applied a photosensitive solution of the following formulation by means of a wire bar in such a manner as to have a dry film thickness of 20 $\mu$. The applied solution was dried in a hot air of 70° C to obtain a photosensitive element as a sample.

| | |
|---|---|
| polyvinylcarbazole | 1 part by weight |
| 2,4,7-trinitro-9-fluorenone | 1 part by weight |
| polybiphenyl chloride | 0.3 parts by weight |
| exemplified fluorine-contained resin (2) | 0.1 part by weight |
| tetrahydrofuran | 5 parts by weight |

The above process was repeated without use of the exemplified resin (2) to make a comparative sample. These sample and comparative sample were placed in position in the duplicator Model U-BIX-800 for continuous reproduction operation. As a result, the sample of the invention was superior to the comparative example in amount of toner filming and reduction of image density.

EXAMPLE 4

Exemplified fluorine-contained resin (1) and FC-706 were, respectively, applied on the surface of the photosensitive layer of the comparative sample (No. 10) of Example 1 to form a covering layer in a dry thickness of 1 $\mu$. Two kinds of comparative samples (Nos. 11 and 12) were obtained. The comparative examples and the samples (Nos. 1 and 9) of Example 1 were subjected to corona discharge at a charging voltage of −5.5 kV so that the surface potential reached −500 V. Then, the thus charged samples and comparative samples were each repeatedly subjected 1 – 100 times to exposure to light at 15 lux.sec by means of a tungsten source, whereupon a residual potential was determined by means of a surface potentiometer.

The test results are shown in Table 2 below.

Table 2

| Sample No. | | amount or thickness of covering layer of fluorine-contained resin | residual potential: One repetition time | residual potential: 100 repetition time |
|---|---|---|---|---|
| Sample | 1 | 1.2 g of exemplified resin No. 1 per 100 g of ZnO | 5 V | 6 V |
| | 9 | 1.2 g of FC-706 per 100 g of ZnO | 5 V | 7 V |
| Comparative sample | 11 | thickness of covering layer of exemplified resin (1) = 1 $\mu$ | 30 V | 60 V |
| | 12 | thickness of covering layer of FC-706 = 1 $\mu$ | 50 V | 75 V |

As will be clear from the Table, the samples of the invention in which the above-indicated fluorine-contained resins are, respectively, contained in the photosensitive layer are significantly reduced in residual potential when compared with the comparative samples in which a 1 $\mu$ thick fluorine-contained resin covering layer is formed on the surface of the photosensitive layer. When the charging and exposure to light was repeatedly effected, the residual potential of the comparative samples was sharply increased, making it impossible to use such comparative samples in practical application, while the samples of the invention was scarcely increased in residual potential.

We claim:

1. A photosensitive article for electrophotography having a conductive substrate and a photosensitive coating of a dried solution or dispersion comprising a photoconductive material, a binder and a fluorine-containing compound characterized by a plurality of units represented by the following structural formula:

$$-[X]_{m_1}-[Y]_{m_2}-$$

wherein:

X is a fluorine-containing monomeric unit selected from the group consisting of:

$$-CF_2-\underset{\underset{R_1}{|}}{CF}- \qquad \text{a)}$$

wherein $R_1$ is F, Cl or $CF_3$; and $$-CH_2-\overset{\overset{R_2}{|}}{\underset{\underset{B-(CF_2)_{n_1}F}{|}}{C}}- \qquad \text{b)}$$

wherein:

$R_2$ is H or $CH_3$,

B is i. $-COZ_1(CH_2)_n$ - where $Z_1$ is —O— or —NH— and $n_2$ is an integer of 1 – 4, ii. —OOC—;

$$-COZ_2(CH_2)_{n_3}-N\begin{matrix}/\ R_3\\ \backslash\ SO_2-\end{matrix} \qquad \text{(iii)}$$

where $Z_2$ is —O— or —NH—, $n_3$ is an integer of 1 – 4 and $R_3$ is an alkyl group having 1 – 4 carbon atoms; or $$-CON\begin{matrix}/\ R_3\\ \backslash\end{matrix} \qquad \text{(iv)}$$

where $R_3$ is an alkyl having 1 – 4 carbon atoms, and $n_1$ is an integer of 1 – 18;

and Y represents a monomer copolymerizable with X;

with the proviso that when X is

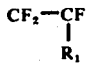

then $m_1/m_1+m_2$ is 0.95 – 0.1 and when X is

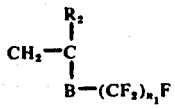

then $m_1/m_1+m_2$ is 1.0 – 0.1

2. The photosensitive article of claim 1 wherein Y is the same as X or is a different polymerizable monomer unit selected from the group consisting of acrylic acid alkyl esters, methacrylic acid alkyl esters, vinylpyrrolidone, vinyl chloride, vinyl acetate, vinylbutyral, styrene, acrylamide, vinylidene fluoride, acrylonitrile and butadiene.

3. An electrophotographic photosensitive material as claimed in claim 1 wherein said fluorine-containing compound is contained in an amount of 0.01 – 10% by weight of said photoconductive material.

4. An electrophotographic photosensitive material as claimed in claim 1 wherein said fluorine-containing compound has an average molecular weight of 10,000 – 500,000.

* * * * *

UNITED STATES PATENT OFFICE

CERTIFICATE OF CORRECTION

Patent No. 4,030,921 Dated June 21, 1977

Inventor(s) AKIRA ET AL

It is certified that error appears in the above-identified patent and that said Letters Patent are hereby corrected as shown below:

On the cover page, the names of the inventors should appear as follows:

AKIRA KATO; AKIRA ITOH; TOHRU UCHIDA and MASAO ISHIHARA

Column 3, line 20, "$COA(CH_2)_n$" should read --$COA(CH_2)_{n_4}$--.

Column 10, line 50, "$COZ_1(CH_2)_n$" should read --$COZ_1(CH_2)_{n_2}$--.

Signed and Sealed this

Fourth Day of October 1977

[SEAL]

Attest:

RUTH C. MASON
Attesting Officer

LUTRELLE F. PARKER
Acting Commissioner of Patents and Trademarks